United States Patent [19]

Copeland

[11] Patent Number: 4,675,654

[45] Date of Patent: Jun. 23, 1987

[54] ALARM MONITORING DEVICE

[76] Inventor: Bobby E. Copeland, 73 A West Lee St., Chickasaw, Ala. 36611

[21] Appl. No.: 670,291

[22] Filed: Nov. 13, 1984

[51] Int. Cl.[4] ..... G08B 23/00

[52] U.S. Cl. ..... 340/502; 340/514; 340/525; 340/52 F; 340/52 R

[58] Field of Search ..... 340/502, 500, 501, 504, 340/503, 508, 513, 514, 521, 524, 525, 52 F, 52 R; 364/569, 442, 424.1, 426; 307/10 LS

[56] References Cited

U.S. PATENT DOCUMENTS

| | | | |
|---|---|---|---|
| 2,934,752 | 4/1960 | Arrasmith | 340/502 |
| 3,381,286 | 4/1968 | Walsh | 340/502 |
| 3,456,251 | 7/1969 | Smith et al. | 340/502 |
| 3,480,939 | 11/1969 | Dees | 340/502 |
| 3,512,147 | 5/1970 | Martin | 340/502 |

*Primary Examiner*—Donnie L. Crosland
*Attorney, Agent, or Firm*—George A. Bode; D. Neil LaHaye

[57] ABSTRACT

An alarm monitoring system which simultaneously provides a bright alarm light and audible alarm upon the occurrence of an abnormal condition in a function being monitored. The alarm light is reduced to a dim illumination upon acknowledging of the alarm condition by the operator and the audible alarm is also deactivated. The dimmed alarm indication reduces detrimental effect of night vision while maintaining notice of an abnormal condition. Upon acknowledging the alarm condition, an electro-mechanical relay having two normally closed contacts and one normally opened contact is energized to redirect current flow to the alarm indicator lamp through a resistor and cause the dimmed illumination of the indicator lamp. A plurality of alarm indicator circuits are connected in parallel and have diodes connected in the circuitry to prevent electrical feedback in the system from causing false alarm indications in the corresponding alarm circuits. A test switch is provided which allows trouble shooting of the apparatus while the system is in normal use or out of use.

20 Claims, 3 Drawing Figures

ALARM MONITORING DEVICE

BACKGROUND OF THE INVENTION

1. Field of the Invention

This invention relates to an alarm monitoring system and more particularly relates to an engine system for monitoring a variety of conditions and alerting the operator to an abnormal condition of any or all of them.

2. General Background

In the present state of the art, alarm monitoring systems used to monitor the conditions of various engine systems and other general systems such as on ships, trains, and deisel trucks suffer from a variety of drawbacks.

A large marjority of systems presently in use are provided with a flashing light to indicate an abnormal condition of a particular system or function being monitored and may be used in conjunction with or without an audible alarm. Upon acknowledgement of the alarm condition by the operator, the system circuitry will cause the light to stop flashing and transfer to a constant bright glowing condition with any audible alarm being deactivated. This presents a particular problem during night time operations as it is well known that any bright lights will have a detrimental effect on night vision. This can prove to be hazardous to the operators of such vehicles as ships, trains or trucks.

Problems encountered with solid state circuitry using printed circuit boards include the following: it often does not stand up well to vibrations encountered in the above operating conditions; it is difficult to trouble shoot for those inexperienced in electronics; and the necessary equipment for trouble shooting is often not present. Normally, each circuit must be tested individually and in sequence. Sequencing may be disturbed if the system is shut down and then re-activated and a separate mode must often be switched to for testing purposes.

Alarm or monitoring systems of which applicant is aware include the following:

U.S. Pat. No. 3,292,568 entitled "Protective Circuit For Boats" teaches an electrical protective system which forms a part of the starting circuit for an internal combustion engine and a monitoring circuit for a boar that has a plurality of alarms for various functions. The circuitry includes a detector for sensing dangerous concentrations of fuel vapor and a time delay relay for delaying the operation of the engine for a predetermined time after the ignition switch is closed. A blower, which operates during the time delay period and is automatically controlled, operates at all times when fuel vapors are sensed and is included in the circuitry to remove fuel vapor from the boats bilge compartments so that the hazard of fire and/or explosion is minimized when starting the engine. A pair of relay switches are placed in series with the engine starter switch with the relays being closed to complete the circuit to the starter only when fuel vapor is not being sensed and after the time delay period is lapsed. The device further provides buzzers and a series of lights to give both an audible and visual indication of the conditions of the engine being monitored. While this patent teaches circuitry which monitors various fuctions of a boat engine and a buzzer and a series of lights to give both audible and visual indication of the conditions monitored, it does not include the testing and acknowledging circuitry of the present invention.

U.S. Pat. No. 4,037,578, entitled "Ignition Safety Control System" discloses a digital solid state safety control system which is operatively connected to control the energization of the ignition coil and starter motor of one or more internal combustion engines and the energization of one or more exhaust blowers in ventilating communciation with the engine compartment. A central unit houses the control circuits of the system and is adapted to be connected to safety and warning indicator lights on the control panel.

U.S. Pat. No. 3,599,591, entitled "Safety Lockout Ignition System" discloses an ignition system for power boats for preventing explosions in the engine compartment thereof. The device has time delay relays in series which are connected to a latching relay between the battery and the engine and between the start terminal of the ignition switch and the starter to prevent the engine from being started until blowers have operated for a pre-selected time duration to clear the engine compartment of dangerous fumes. The control latching relay energized by the starter energizes the shut-off time-delay relay after a second predetermined time duration from starting to open the normally closed contacts of a shut-off latching relay halting the operation of the blowers after they have cleared the engine compartment of any fumes which may have accumulated during the starting of the engine.

U.S. Pat. No. 4,214,227, entitled "Instrument Panel Assembly" discloses an instrument panel assembly having a plurality of indicating elements to indicate the condition of several engine systems being monitored and a test switch for concurrently indicating the operability of the individual indicating elements. The indicating elements are indicating lamps which alert the operator to an abnormal condition. This invention is aimed at providing the operator with a means of checking the operability of the indicator lamps to prevent damage to the equipment due to a burned out lamp or a loose connection from preventing the operator of receiving notice of an abnormal engine condition and is aimed at the commercial automobile field.

U.S. Pat. No. 4,231,073, entitled "Automatic Improved Engine Control System Containing Both Solid State Circuits And Relays" discloses solid state circuitry which includes a cranking module for activating and deactivating the cranking of the engine, an overcrank module having time delay circuitry which detects when an overcrank has occurred, reset circuitry which resets the cranking and overcrank module after the engine is started, time delay circuitry which delays fault condition engine shutdown where low oil pressure is indicated and start up circuitry which prevent a false alarm condition at the initiation of the system. This invention utilizes complex solid state circuitry having transistors and digital logic circuitry which is aimed at a different purpose than that of the present invention.

U.S. Pat. No. 4,041,451, entitled "Circuit For Monitoring The Operativeness Of Current Consuming Electrical Devices" discloses a monitoring circuit adapted for use in automotive vehicles especially for monitoring the operation of an electrical device, with an inert-gas read switch used to monitor current flow through electrical devices and provide an indication thereof. An example of electrical devices monitored in an automobile includes tail lights.

U.S. Pat. No. 2,679,641, entitled "Pneumatically Actuated Anti-Overflow Alarm And Safety Device For Tankers" discloses a means for avoiding overflow of the individual tanks of oil tanker vessels during the loading operation. Increased air pressure flowing from a bell causes a bellows to trip an alarm thus warning of a possible overflow condition in one of the tanks in the ship. The system utilizes a simple alarm trip system and provides no indication of which tank is approaching an overflow condition.

SUMMARY OF THE INVENTION

The present invention solves the above problems in a simple and straightforward manner. What is provided is an alarm monitoring system which provides a dim alarm light after the alarm condition is acknowledged, is rugged and withstands vibration, is easy to troubleshoot and test without special sequencing or switching into a test mode and utilizes electronic parts readily available at many electronic stores.

The basic system is comprised of preferably eight alarm circuits connected in parallel which are connected to an audible alarm. A power supply is connected through an "on/off" switch to a "test" switch, "acknowledge" switch and the alarm circuitry. Each alarm circuit is generally comprised of an electromechanical relay having two normally closed contacts and one normally open contact connected between a lamp and a diode which prevents any electrical feedback through the system to other alarm circuits from the relay. A second diode is connected in each alarm circuit to prevent input from the monitored function from causing a false alarm in a different alarm circuit of the system. Each alarm circuit is connected to the audible alarm through a third diode which prevents input from one alarm circuit to the audible alarm from activating other alarm circuits.

The "test" and "acknowledge" switches allow testing of the system while the monitored functions are in operation or shutdown and also allows trouble shooting of the resistors, diodes, lamps and rlays in the system. The system may be shut off and when turned on again will still indicate the same alarm conditions which existed prior to being shut-off as long as the abnormal functions have not been corrected.

BRIEF DESCRIPTION OF THE DRAWINGS

For a further understanding of the nature and objects of the present invention, reference should be had to the following detailed description taken in conjunction with the accompanying drawings in which like parts are given like reference numerals and, wherein.

DETAILED DESCRIPTION OF THE PREFERRED EMBODIMENT

Figure 1:
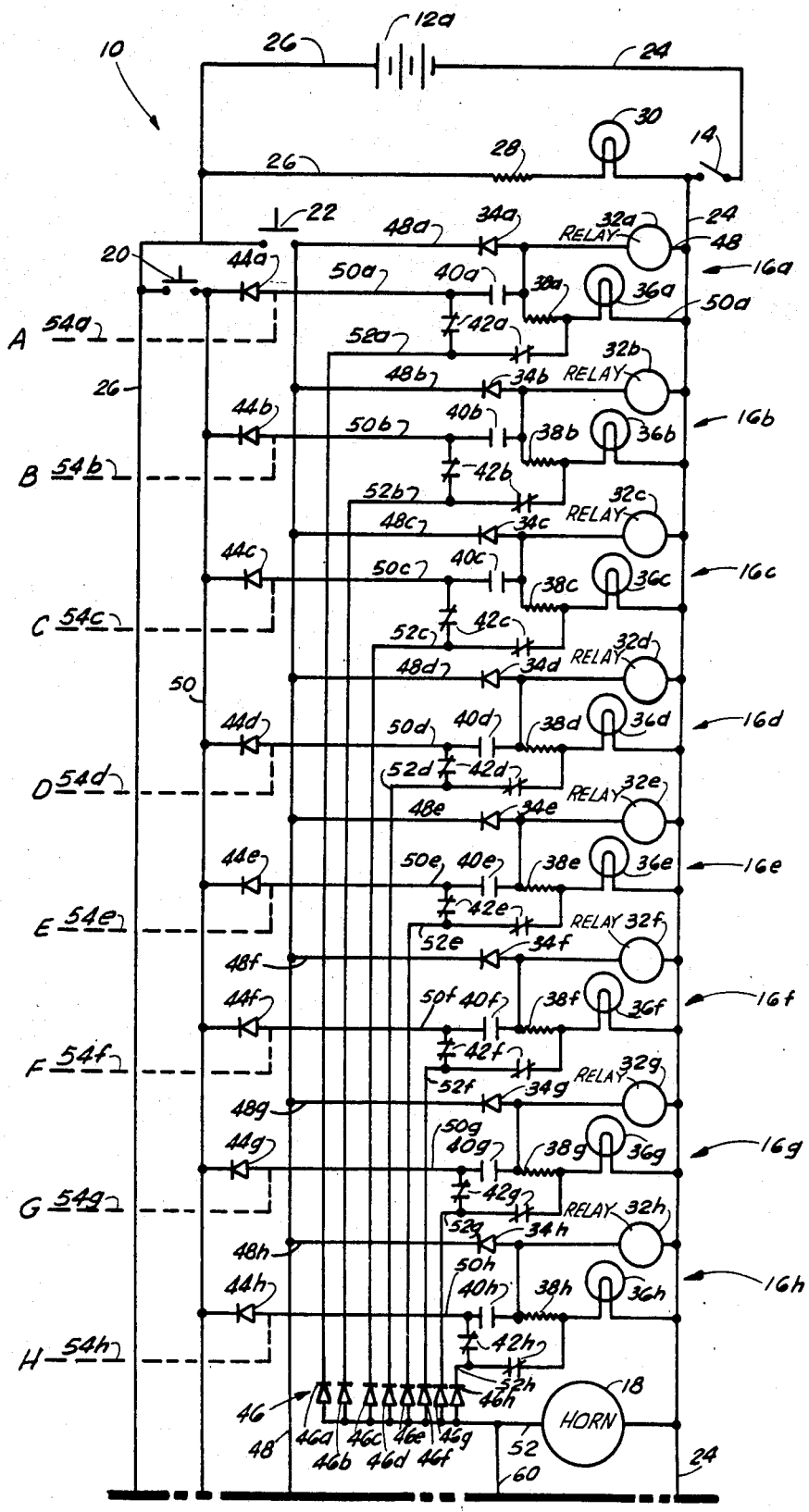
FIG. 1 is a schematic illustration of the preferred embodiment of the system of the present invention.

Referring now to the drawings and particularly FIG. 1, it can be seen that the apparatus is generally referred to by the numeral 10.

Apparatus 10 is generally comprised of power source 12, on/off switch 14, alarm circuit 16*a–h*, audible alarm 18, test switch 20 and acknowledge switch 22.

As apparatus 10 is designed to operate on 12-volt direct current, power source 12 is comprised of a 12-volt D.C. battery in the preferred embodiment but may also be a A.C. power source which is rectified and converted to 12 volts D.C. Power source 12 is connected to on/off switch 14 and the remaining circuitry through electrical lines 24 and 26.

On/off switch 14 is a single pole, single throw (SPST) switch which completes the circuit between lines 24, 26 through resistor 28 and power on indicator lamp 30 when in its closed position. When switch 14 is in the closed position, lamp 30 is illuminated to indicate that power is being delivered to the system and alarm circuits 16*a–h* and audible alarm 18 are enabled for indicating actual alarm conditions or being tested by use of "test" switch 20 and "acknowledge" switch 22. Lamp 30 is comprised of a bulb or lamp commonly used in applications of this type. Resistor 28 is preferably a 100 ohm resistor which is used to limit the current to lamp 30 so that lamp 30 does not glow at full brightness when illuminated. This provides sufficient current to lamp 30 to indicate a power-on condition while minimizing any detrimental effect on the night vision of the operator of apparatus 10.

As alarm circuits 16*a–h* are all identical alarm circuits connected in parallel for monitoring a variety of functions, A–H (i.e., water level A, water temperature B, oil pressure C, gear oil pressure D, generator oil pressure E, generator water pressure F, air pressure G, generator fuel tank H), they will first be generally described with only one circuit then being described in detail. Alarm circuits 16*a–h* are generally comprised of pairs of electro-mechanical relays 32*a–h*, diodes 34*a–h*, lamps 36*a–h*, resistors 38*a–h*, normally open contacts 40*a–h*, pairs of normally closed contacts 42*a–h*, diodes 44*a–h* and diodes 46*a–h*.

Alarm circuit 16a has electro-mechanical relay 32*a* connected to power source 12 via electrical line 48*a* which is in direct series connection with electrical line 24 and electrical line 26 through "acknowledge" switch 22. It can be seen in FIG. 1 that a circuit to relay 32*a* is completed, thus activating relay 32*a*, by the closing of "acknowledge" switch 22. Diode 34*a* is interposed in line 48*a* between acknowledge switch 22 and relay 32*a*. Diode 34*a* is positioned so that it allows flow of electricity to relay 32*a* from line 26 but prevents flow of electricity in the reverse direction from relay 32*a* through diode 34*a*. The purpose of this will be explained at a later point.

Relay 32*a* is a conventional electro-mechanical relay which is provided with two normally closed contacts 42*a* and one normally opened contact 40*a*. Normally closed contacts 42*a* have one contact which connects line 50*a* to line 52*a* and also completes the connection through the lower section of line 50*a* through the second of normally closed contacts 42*a* to lamp 36*a*. This provides a first means for illuminating lamp 36*a* when test switch 20 is closed or an electrical signal from the function being monitored is received through line 54 to indicate an abnormal condition. Line 42*a* is conected through diode 46*a* to audible alarm 18 for activating alarm 18. Line 50*a* is provided with an upper section which provides a second means for completing the circuit through lamp 36*a* to cause illumination thereof. This upper section is connected from lamp 36*a* to line 48*a* between diode 34*a* and relay 32*a* and has provided therebetween resistor 38*a* and normally open contact 40i a which also is connected to test switch 20 and the monitored function through line 50*a*. It can be seen that when contacts 40*a*, 42*a* are in their respective normally open and closed positions, that completion of the circuit to power source 12 through line 50*a*, either by closing of test switch 20 or closing of the switch monitoring the function on line 54, will cause electrical flow through normally closed contacts 42*a* and lamp 36*a*. Lamp 36*a* will then glow at full brightness as resistor 38*a* is bypassed. Also, electricity will be conducted along line 52*a* through diodes 46*a*, activating audible alarm 18. Momentary closing of acknowledge switch 22 completes the circuit to relay 32*a* thus activating relay 32*a* and causing contacts 40*a*, 42*a* to respectively move to closed and opened positions. As contacts 42*a* are now open, electricity flows through now closed contact 40*a* to lamp 36*a* through resistor 38*a*. Lamp 36*a* will now remain illuminated but in a dimmed state due to the effect of resistor 38*a*. Resistor 38*a* is comprised of a 180 ohm resistor in the preferred embodiment. Electricity also flows through relay 32*a* retaining relay 32*a* in its energized state and thus contact 40*a* in a closed position and contacts 42*a* in an opened position. It can be seen that this will also result in deactivation of audible alarm 18 due to the opening of contacts 42*a* and breaking of the circuit to alarm 18. This provides two levels of illumination of lamp 36*a*. The first or bright level is used in normal operation to indicate the occurrence of an abnormal condition in a function being monitored. The second or dim level is used to indicate that the abnormal condition is still present but has been acknowledged by the operator of apparatus 10. The second or dim level serves to minimize or prevent any detrimental effect on the night vision of the operator while still indicating the presence of an abnormal condition. It should be noted that when circuit 50*a* is completed through normally closed contacts 42*a* that resistor 38*a* prevents a sufficient amount of electrical flow into line 48*a* from causing energizing of relay 32*a* and thus movement of contacts of 40*a*, 42*a*.

Having described alarm circuit 16*a*, it can be seen that remaining alarm circuits 16*b*–16*h* are identical to alarm circuit 16*a* and are connected in parallel by electrical lines 24, 48 and 50. The parallel circuitry eliminates problems normally encountered when series connected circuit are used.

Diodes 34*a–h*, 44*a–h* and 46*a–h* are preferably minature diodes and serve a special purpose in the multiple alarm circuit of apparatus 10. Diodes 34*a–h* prevent any backflow of electricity from the acknowledging portion of one alarm circuit into the acknowledging portion of the remaining circuits and indicating an acknowledged alarm condition where one does not exist. Diodes 44*a–h* and 46*a–h* both prevent an unacknowledged alarm condition in one alarm circuit from causing the remaining circuits to indicate the presence of an unacknowledge condition where one does not exist.

Figure 2:
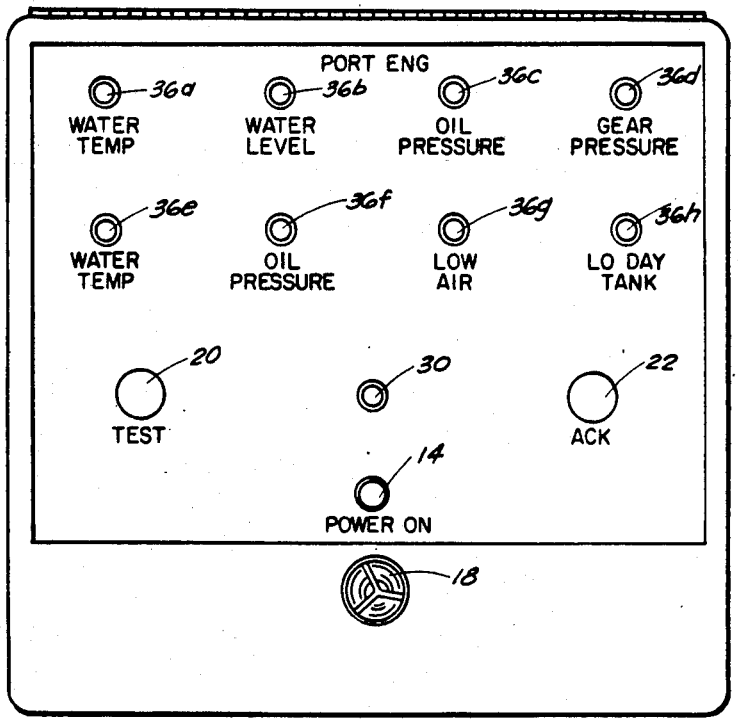
FIG. 2 is an illustration of the indicator panel of the system of the present invention.

FIG. 2 illustates a view of indicator panel 56 at it would appear with apparatus 10 installed and ready for use. Indicator lamps 36*a–h* are illustrated positioned in two rows and labeled with examples of a variety of functions which may be monitored by apparatus 10. On/off switch 14, power indicator lamp 30, audible alarm 18, test switch 20 and acknowledge switch 22 are all positioned on indicator panel 56 for easy access thereto.

Figure 3:
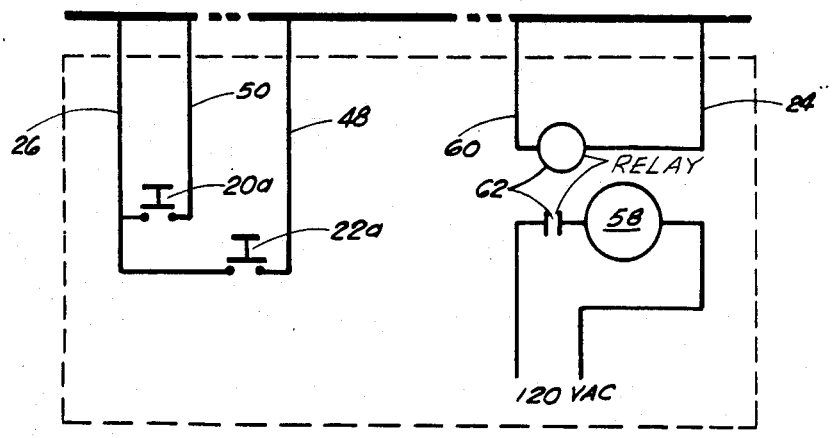
FIG. 3 is a schematic illustration of optional remote "test," "acknowledge" and alarm circuitry of the system of the present invention.

FIG. 3 is a schematic view of an optional test switch 20*a*, acknowledge switch 22*a* and audible alarm 58 which may be positioned at a location remote from apparatus 10. Lines 16, 48 and 50 are extended to connected with remote test switch 20*a* and remote acknowledge switch 22*a*. Electrical line 60, which is an extension of line 52, and an extension of line 24 are connected to relay 62. Upon activation of audible alarm 18, relay 62 is energized, activating remote alarm 58. Remote alarm 58 will also be deactivated simultaneously with alarm 18 during normal operation of apparatus 10. Alarm 58 is illustrated as being powered by 120 volts A.C. but may be powered by any conventional power source.

In operation, apparatus 10 is used to indicate to the operator an abnormal condition of the functions being monitored and may also be tested through the use of test switch 20 and acknowledge switch 22 to indicate the operability of the various components of apparatus 10.

In testing apparatus 10, on/off switch 14 is moved to the "on" position completing the circuit between power source 12 and indicator lamp 30, thus causing indicator lamp 30 to be illuminated and indicate that apparatus 10 is receiving power. Pushing and holding test switch 20 in the closed position completes the circuit through diodes 44*a–h* and normally closed contacts 42*a* to complete the circuits to indicator lamps 36*a–h* and audible alarm 18. Indicator lamps 36*a–h* all will glow at full brightness if all system components are in proper working order and audible working alarm 18 will be activated. Acknowledge switch 22 is then closed momentarily while test switch 20 is maintained in its closed position. This completes the circuit through diodes 34*a–h* causing relays 32*a–h* to close or be energized thus causing normally open contacts 40*a–h* to close and normally closed contacts 42*a–h* to open. This causes rerouting of the electrical circuit through the upper portion of lines 50*a–h* to pass through resistors 38*a–h* and cause indicator lamps 36*a–h* to glow at a reduced factor and indicate an acknowledged alarm condition. Audible alarm 18 is also deactivated due to the opening of the circuit by opening of the normally closed contacts 42*a–h*. Any resistors 38*a–h* which are operating at reduced efficiency will be indicated in the corresponding alarm circuit by an indicator lamp which glows in its dimmed state due to sufficient electricity flowing through the resistor to cause energization of its corresponding relay. This indication will occur upon closing of test switch 20 before acknowledge switch 22 is moved into its closed position and provides a means of trouble shooting resistors 38*a–h*.

Closing acknowledge switch 22 without previous closing of test switch 20 provides a means of testing relays 32*a–h* and resistors 38*a–h*. During normal functioning of these components, all indicator lamps 36*a–h* should glow in their dim state without audible alarm 18 being sounded. An indication of a faulty relay or resistor would be provided by any of indicator lamps 36*a* failing to be illuminated or being illuminated at its full brightness level. The relays may be visually checked by opening apparatus 10 at indicator panel 56 and visually checking the movement of relays 32*a–h* as acknowledge switch 22 is closed and opened. If all the relays are functioning properly, then this provides an indication that the corresponding resistor is faulty.

During normal operation of apparatus 10, on/off switch 14 is moved to its closed position and power on indicator lamp 30 will be illuminated to indicate that apparatus 10 is receiving power from power source 12. A malfunction or abnormal condition which causes closing of a switch (not shown) such as in alarm circuit 16*a* will provide electrical signals through line 54*a* into line 50*a* through contacts 42*a* and illuminating of indicator lamp 36*a*. Audible alarm 18 will also be activated. The illumination of indicator lamp 36*a* and activation of audible alarm 18 indicates to the operator of apparatus 10 that the function being monitored by alarm circuit 16*a* is in an abnormal condition. The operator may acknowledge the alarm condition by momentarily closing of acknowledge switch 22. This causes relay 32*a* to be energized with movement of contacts 40*a*, 42*a* as described earlier, thus causing deactivation of audible alarm 18 and indicator lamp 36*a* to glow and end a dim state. The dimmed illumination of indictor lamp 36*a* indicates that the abnormal condition is still in existence and has not been corrected. The remaining circuits will operate in a manner similar to that of as described should an abnormal condition occur in the function being monitored by each respective alarm circuit. It can be seen that failure of diodes 34*a–h* or 44*a–h* upon activation of one of the alarm circuits will cause the remaining alarm circuits to be activated and indicate a false alarm condition. This also provides a means of trouble shooting apparatus 10 during normal operation by checking each function being monitored.

The alarm indication will not be lost by apparatus 10 as long as the abnormal condition remains in existence. Apparatus 10 may be turned "off" and then turned "on" again at on/off switch 14 and the abnormal condition will re-alert the operator to its existence by again activating the indicator lamp at full brightness and sounding audible alarm 18.

Apparatus 10 is illustrated in its schematic view in FIG. 1 without providing specific negative or positive sides to the circuitry of apparatus 10 as it is designed to be operable on a positive or negative ground so that it is adaptable to a variety of systems and functions to be monitored.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An alarm monitoring system for monitoring a function and indicating an abnormal condition thereof, comprising:

a. a power source;

b. switch means connected to said power source for selectively providing power to and enabling said system;

c. a visual alarm indicator connected to said power source by said switch means and said function being monitored and activated by an abnormal condition of said function;

d. an audible alarm circuit activated simultaneously with said visual alarm indicator upon occurrence of said abnormal condition;

e. means connected to said power source and said alarm indicator for acknowledging said abnormal condition, limiting the current to said visual alarm indicator and deactivating said audible alarm circuit;

f. means for testing the operability of said system; and g. means for preventing feedback of current through the circuit including said visual alarm indicator, said switch means, said function being monitored and said power source to said visual alarm indicator, thereby preventing false alarm indications.

2. The apparatus of claim 1, further comprising an indicator lamp for indicating the enabling of said system.

3. The apparatus of claim 2, further comprising means for limiting the current to said indicator lamp.

4. The apparatus of claim 3 wherein said means for limiting said current comprises a resistor.

5. The apparatus of claim 1 wherein said alarm indicator comprises an indicator lamp.

6. The apparatus of claim 1 wherein said means for acknowledging said abnormal condition comprises:

a. means for limiting the current to said alarm indicators;

b. an electro-mechanical relay having two normally closed contacts and one normally opened contact respectively movable to opened and closed positions upon energizing of said relay, directing current from said power source to said alarm indicator through said current limiting means and deactivating said audible alarm when said relay is energized; and c. a switch movable between a first normally opened positioned and a second closed position energizing said relay when momentarily moved to said second closed position.

7. The apparatus of claim 6 wherein said current limiting means comprises a resistor.

8. The apparatus of claim 1 wherein said means for testing the operability of said system comprises a switch movable from a normally opened position to a closed position activating said alarm indicator and said audible alarm.

9. An alarm monitoring system for monitoring a plurality of functions and indicating an abnormal condition thereof, comprising:

a. a power source;

b. switch means connected to said power source for selectively providing power to and enabling said system;

c. a plurality of indicator lamps connected in parallel circuits to said power source by said switch means and said functions being monitored, each of said lamps being illuminated by an abnormal condition of one of said respective functions;

d. an audible alarm circuit connected to said indicator lamps and activated simultaneously with any one of said indicator lamps upon occurrence of said abnormal condition of any of said functions;

e. means connected to said power source and said indicator lamps for acknowledging said abnormal condition, limiting the current to said indicator lamps thereby dimming the illumination thereof and deactivating said audible alarm when said illumination is dimmed;

f. means for preventing feedback of current through said parallel circuits to said indicator lamps, thereby preventing false alarm indications.

10. The apparatus of claim 9 further comprising an indicator lamp for indicating the enabling of said system.

11. The apparatus of claim 9, further comprising means for limiting the current to said indicator lamp.

12. The apparatus of claim 9 wherein said means for limiting current comprises a resistor.

13. The apparatus of claim 9 wherein the means for acknowledging said abnormal condition comprises:

a. means connected to each of said indicator lamps for selectively limiting the current to each of said indicator lamps;

b. an electro-mechanical relay connected to each of said indicator lamps having two normally closed contacts and one normally opened contact respectively movable to opened and closed positions upon energizing of said relay, directing current from said power source to said indicator lamp through said current limiting means and deactivating said audible alarm when said relay is energized; and c. a acknowledge switch movable between a first normally opened position and a second closed position, energizing said relay when momentarily moved to said closed position.

14. The apparatus of claim 13 wherein said current limiting means comprises a resistor.

15. The apparatus of claim 13 wherein said means for testing the operability of said system further comprises a switch movable from a normally opened position to a closed position, illuminating said indicator lamps and activating said audible alarm.

16. The apparatus of claim 13 wherein said means for preventing backfeed of electricity comprises:

a. a diode connected between said acknowledge switch and each of said relays;

b. a diode connected between said test switch and each of said indicator lamps; and c. a diode connected between said audible alarm and each of said indicator lamps.

17. An alarm monitoring system for monitoring a plurality of functions and indicating an abnormal condition thereof, comprising:

a. a power source;

b. switch emans connected to said power source for selectively providing power to and enabling said system;

c. an indicator lamp for indicating the enabling of said system;

d. a plurality of indicator lamps connected in parallel circuits to said power source by said switch means and said functions being monitored, each of said lamps being illuminated at full brightness as a result of an abnormal condition of one of said respective functions;

e. an audible alarm circuit connected to said indicating lamps and activated simultaneously with said indicator lamps upon occurrence of said abnormal condition of any of said functions;

f. a resistor connected to each of said indicator lamps;

g. an electro-mechanical relay connected to said power source and each of said indicator lamps having two normally closed contacts and one normally opened contact respectively movable to opened and closed positions upon energizing of said relay, redirecting current from said power source to said indicator lamp through said resistor causing reduced illumination of said indicator lamp and deactivation of said audible alarm when said relay is energized;

h. a first switch movable between a first normally opened position and a second closed position, energizing said relay when momentarily moved to said second closed position;

i. a second switch movable from a normally opened position to a closed position, activating said indicating lamps and said audible alarm; and j. means for preventing feedback of current through said parallel circuits to said indicator lamps, thereby preventing false alarm indications.

18. The apparatus of claim 17 wherein said resistor comprises a 180 ohm resistor.

19. The apparatus of claim 17 wherein said first switch is an acknowledge switch and said second switch is a test switch.

20. The apparatus of claim 19, further comprising a remote test switch, acknowledge switch and audible alarm.

* * * * *